US010046450B2

(12) United States Patent
Bernhart et al.

(10) Patent No.: US 10,046,450 B2
(45) Date of Patent: Aug. 14, 2018

(54) MODE CHANGE KNOB ASSEMBLY

(71) Applicant: Black & Decker Inc., Newark, DE (US)

(72) Inventors: Ralf Bernhart, Idstein (DE); Martin Soika, Grosskrotzenburg (DE)

(73) Assignee: Black & Decker Inc., New Britain, CT (US)

( * ) Notice: Subject to any disclaimer, the term of this patent is extended or adjusted under 35 U.S.C. 154(b) by 415 days.

(21) Appl. No.: 14/801,900

(22) Filed: Jul. 17, 2015

(65) Prior Publication Data

US 2016/0023344 A1 Jan. 28, 2016

(30) Foreign Application Priority Data

Jul. 28, 2014 (GB) ..... 1413293.0

(51) Int. Cl.

| | |
|---|---|
| ***E02D 7/02*** | (2006.01) |
| ***B25D 16/00*** | (2006.01) |
| ***B25F 5/00*** | (2006.01) |
| ***G05G 1/10*** | (2006.01) |
| ***B25F 5/02*** | (2006.01) |

(52) U.S. Cl.

CPC ..... *B25D 16/006* (2013.01); *B25F 5/001* (2013.01); *B25F 5/02* (2013.01); *G05G 1/10* (2013.01); *B25D 2250/065* (2013.01); *B25D 2250/085* (2013.01); *B25D 2250/255* (2013.01); *B25D 2250/371* (2013.01)

(58) Field of Classification Search

CPC ..... G05G 1/10; G05G 1/12; B25D 16/006; G05B 15/02

USPC ..... 173/48

See application file for complete search history.

(56) References Cited

U.S. PATENT DOCUMENTS

| | | | | |
|---|---|---|---|---|
| 3,834,468 | A * | 9/1974 | Hettich | B25D 16/00 173/109 |
| 4,506,743 | A * | 3/1985 | Grossmann | B23B 45/008 173/109 |
| 4,763,733 | A * | 8/1988 | Neumaier | B25D 16/006 173/109 |
| 6,109,364 | A * | 8/2000 | Demuth | B25D 16/006 173/48 |
| 6,176,321 | B1 | 1/2001 | Arakawa et al. | |
| 7,174,969 | B2 | 2/2007 | Droste | |
| 7,306,048 | B2 | 12/2007 | Yamazaki | |

(Continued)

FOREIGN PATENT DOCUMENTS

| | | |
|---|---|---|
| DE | 3240466 | 11/1982 |
| DE | 3414898 | 11/1985 |

(Continued)

OTHER PUBLICATIONS

European search report dated Dec. 4, 2015 issued in corresponding EP patent application.

*Primary Examiner* — Robert Long

(74) *Attorney, Agent, or Firm* — Amir R. Rohani

(57) ABSTRACT

A knob assembly for a power tool comprising: a knob having a slot and knob recess, the slot and knob recess intersecting each other at an intersection within the knob; a latch slideably mounted within the slot; a peg located within the knob recess; wherein the peg and latch engage with each other via the intersection in order for the peg to retain the latch within the slot and for the latch to retain peg within the knob recess.

9 Claims, 6 Drawing Sheets

(56) References Cited

U.S. PATENT DOCUMENTS

| | | | | |
|---|---|---|---|---|
| 7,322,427 | B2 | 1/2008 | Shimma et al. | |
| 7,325,624 | B2 | 2/2008 | Yamazaki | |
| 7,931,095 | B2 | 4/2011 | Machida et al. | |
| 8,067,709 | B2 | 11/2011 | Han et al. | |
| 8,454,412 | B2 * | 6/2013 | Esenwein | B24B 55/052 451/344 |
| 2002/0134563 | A1 * | 9/2002 | Stirm | B25D 16/00 173/201 |
| 2004/0231866 | A1 * | 11/2004 | Droste | B25D 16/006 173/48 |
| 2008/0210448 | A1 * | 9/2008 | Ullrich | B25D 16/006 173/104 |
| 2009/0145617 | A1 * | 6/2009 | Duesselberg | B25D 16/006 173/48 |
| 2010/0084151 | A1 * | 4/2010 | Kuhnle | B25D 16/006 173/47 |
| 2010/0200380 | A1 * | 8/2010 | Staas | B25D 16/006 200/293 |
| 2012/0205131 | A1 | 8/2012 | Furusawa et al. | |
| 2015/0284976 | A1 * | 10/2015 | Singh | E05B 47/0047 292/341.17 |

FOREIGN PATENT DOCUMENTS

| | | |
|---|---|---|
| DE | 3436220 | 4/1986 |
| DE | 19581048 | 10/1996 |
| DE | 102004057686 | 6/2006 |
| DE | 102007010180 | 9/2008 |
| EP | 04737716 | 7/1991 |
| EP | 0 759 342 | 2/1997 |
| EP | 0836902 | 4/1998 |
| EP | 1477280 | 11/2004 |
| EP | 1537955 | 6/2005 |
| EP | 1932625 | 6/2008 |
| EP | 2 218 553 | 8/2010 |
| JP | 2012-171066 | 9/2012 |
| WO | 2007025795 | 3/2007 |
| WO | 2008009211 | 1/2008 |
| WO | 2012118370 | 9/2012 |

* cited by examiner

MODE CHANGE KNOB ASSEMBLY

CROSS-REFERENCE TO RELATED APPLICATIONS

This application claims priority to UK Application No. GB 1413293.0, filed on Jul. 28, 2014, entitled "Mode Change Knob Assembly." The content of this application is incorporated herein by reference in its entirety.

FIELD OF THE INVENTION

The present invention relates to a knob assembly, particularly a mode change knob assembly for a hammer drill.

BACKGROUND OF THE INVENTION

A hammer drill comprises a tool holder in which a cutting tool, such as a drill bit, can be supported and driven by the hammer drill. The hammer drill can often drive the cutting tool in three different ways, each being referred to as a mode of operation. The cutting tool can be driven in a hammering mode, a rotary mode and a combined hammer and rotary mode. A hammer drill will typically comprise an electric motor and a transmission mechanism by which the rotary output of the electric motor can either rotationally drive the cutting tool to perform the rotary mode or repetitively strike the cutting tool to perform the hammer mode or rotationally drive and repetitively strike the cutting tool to perform the combined hammer and rotary mode.

EP1157788 discloses a typical hammer drill.

BRIEF SUMMARY OF THE INVENTION

In order to change the mode of operation, there is provided a mode change mechanism. The mode change mechanism is typically operated using a mode change knob assembly. EP0437716 discloses an example of a mode change knob assembly.

Accordingly, there is provided a knob assembly in accordance with claim 1 and a method in accordance with claim 11.

BRIEF DESCRIPTION OF THE DRAWINGS

An embodiment of the present invention will now be described with reference to the accompanying drawings of which.

Figure 1:
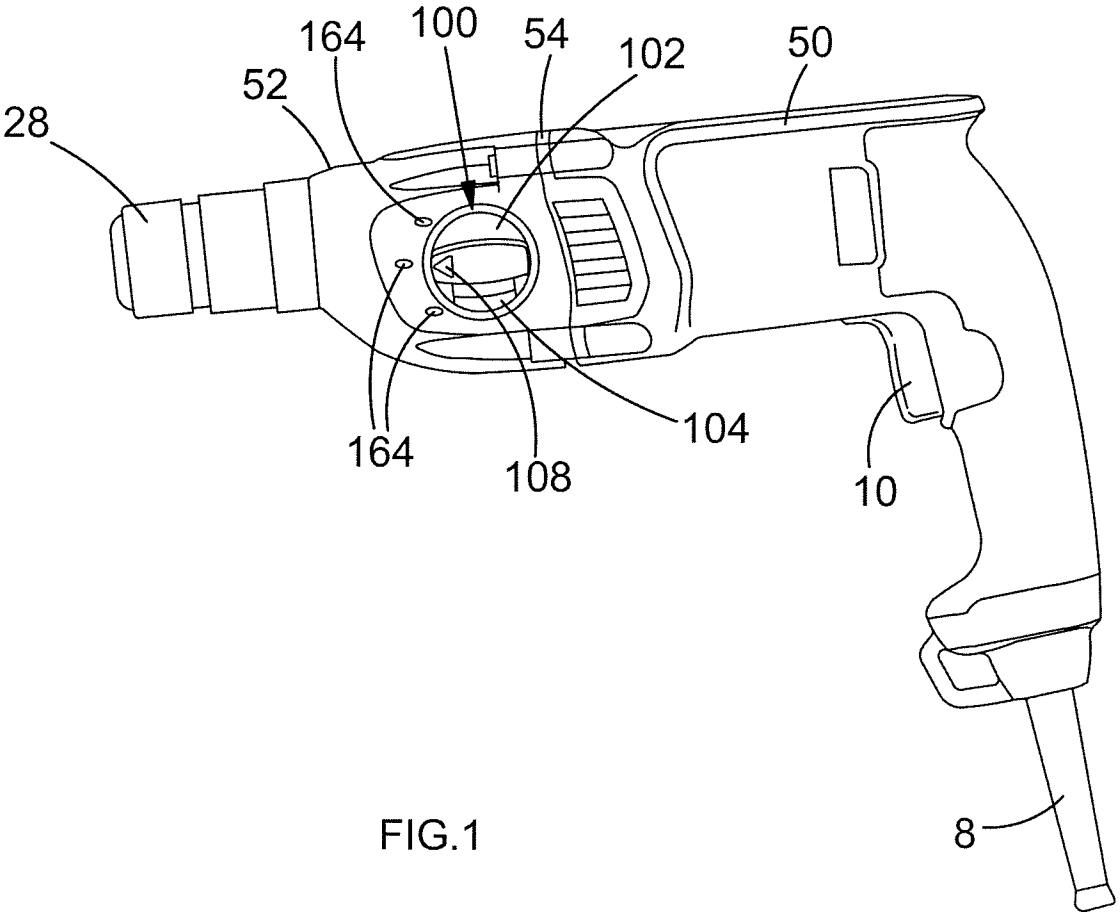
FIG. 1 shows a side view of a hammer drill in accordance with the present embodiment of the invention.
Figure 2:
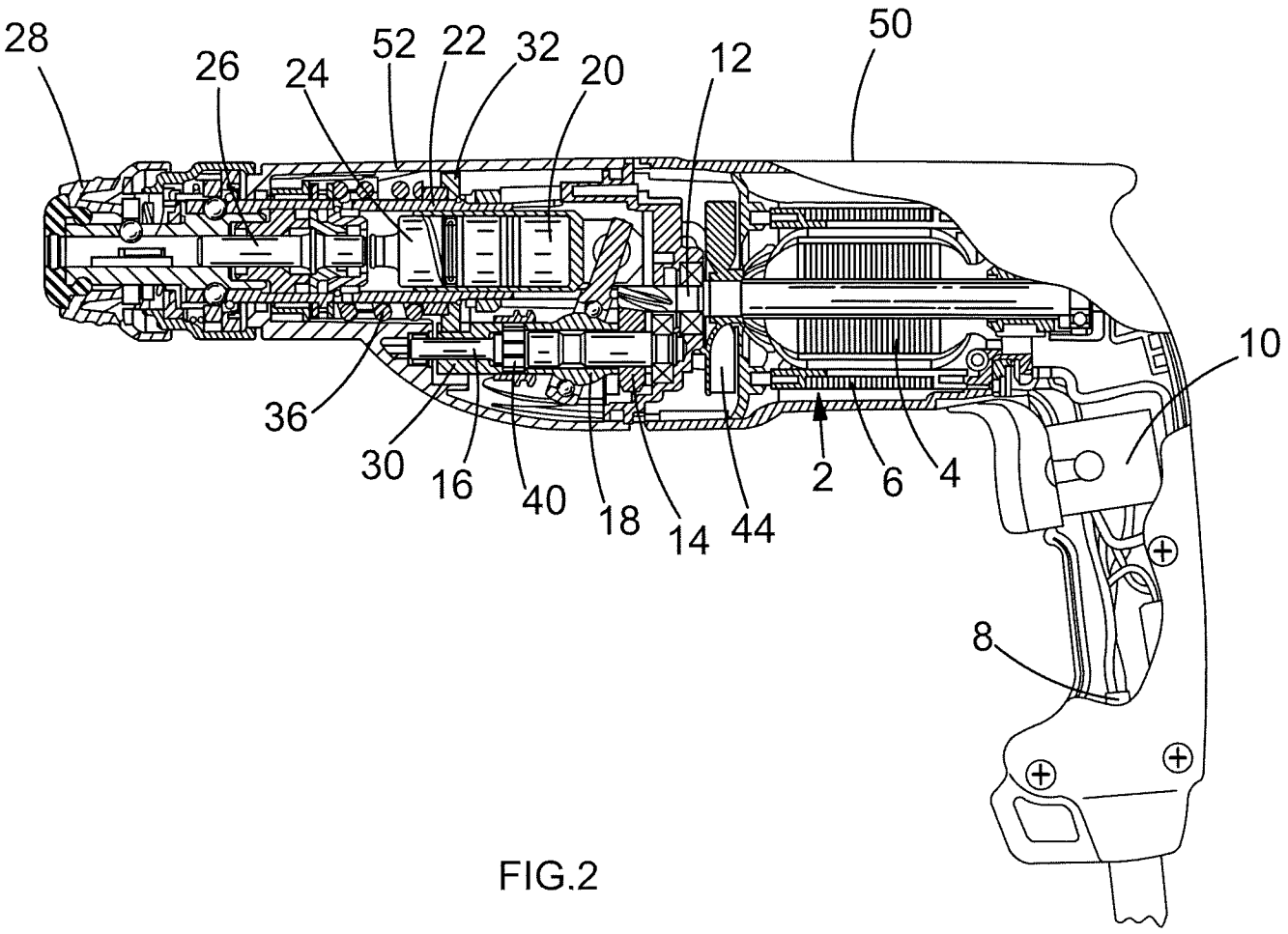
FIG. 2 shows a vertical cross sectional view of the hammer drill of FIG. 1.

Referring to the FIGS. 1 and 2, the hammer drill comprises a motor housing 50 which connects to a transmission housing 52 via intermediate housing 54.

DETAILED DESCRIPTION OF THE INVENTION

Mounted within the motor housing 50 is an electric motor 2 having a rotor 4 mounted within a stator 6. The motor 2 is powered via an electric cable 8 which connects to the motor via an electric switch 10. Depression of the switch causes the rotor 4 to rotate. A fan 44 is mounted on the output spindle 12 of the motor to draw air over the motor 2.

The transmission mechanism will now be described.

The output spindle 12 of the motor comprises teeth which mesh with a gear 14 on an intermediate shaft 16 to rotatingly drive the intermediate shaft 16. A wobble bearing 18 is mounted on the intermediate shaft 16 which, when activated, is rotationally driven by the intermediate shaft 16 to reciprocatingly drive a piston 20 located within a hollow spindle 22. The piston reciprocatingly drives a ram 24 via an air cushion. The ram 24 in turn repetitively strikes a beat piece 26 which strikes the end of a cutting tool when held in a tool holder 28 attached to the end of the hollow spindle 22 at the front of the transmission housing 52. Also mounted on the intermediate shaft 16 is a second gear 30 which meshes with a third gear 32 mounted on the hollow spindle 22. When activated, the intermediate shaft 16 rotationally drives the hollow spindle 22 via the second and third gears, the third gear 32 driving the hollow spindle 22 via a torque clutch 36. Rotation of the hollow spindle 22 results in the rotation of the tool holder 28. The wobble bearing 18 and rotary drive are activated via a mode change mechanism 40. The operation of such a hammer drill is well known in art and therefore will not be discussed any further.

The mode change mechanism is operated using a mod change knob assembly 100.

Figure 3:
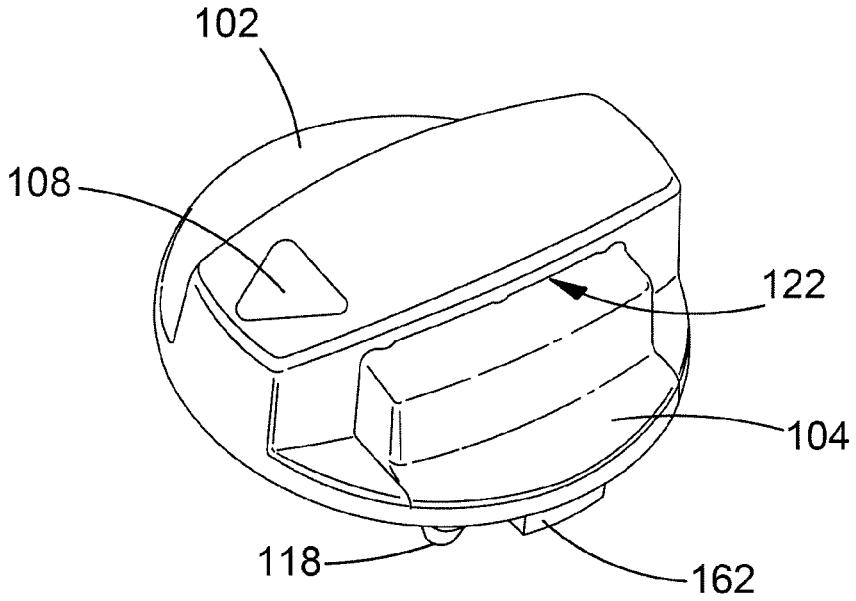
FIG. 3 shows a top perspective view the mode change knob assembly of the hammer drill of FIG. 1.
Figure 4:
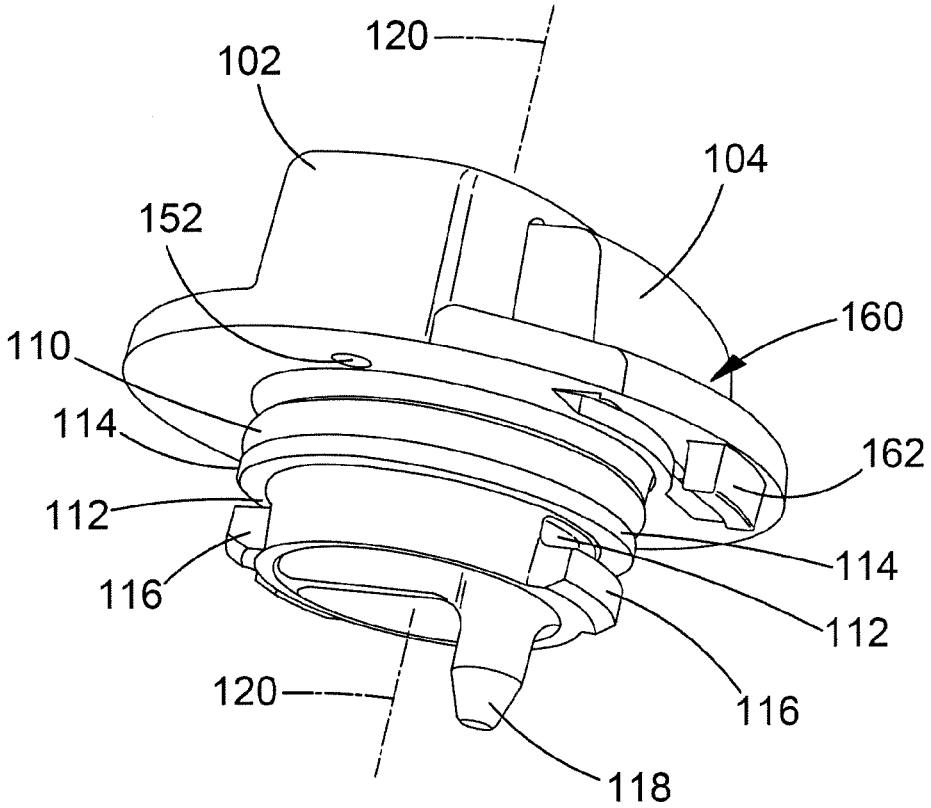
FIG. 4 shows a bottom perspective view the mode change knob assembly of the hammer drill of FIG. 1.
Figure 6:
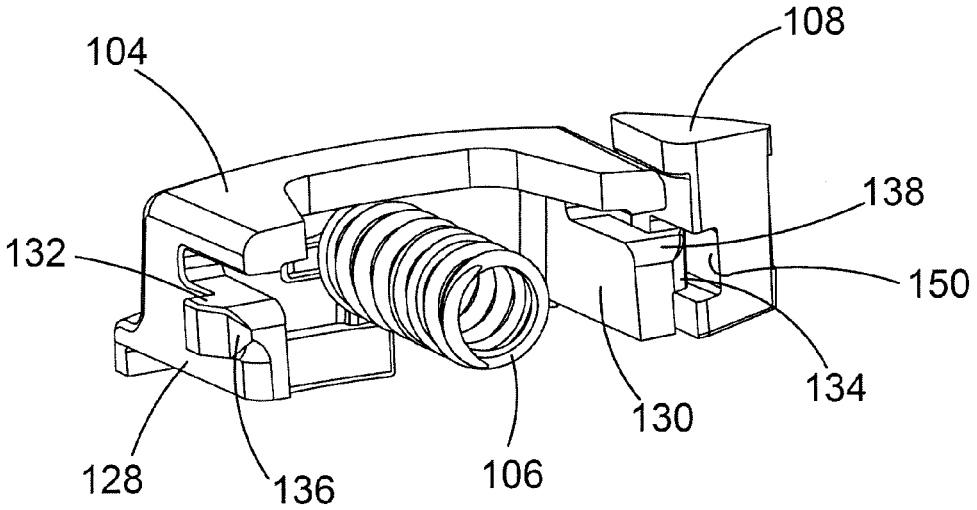
FIG. 6 shows a rear view of the latch, biasing spring and indicator peg only.

Referring to FIGS. 3 and 4, the mode change knob assembly 100 comprises a knob 102, a latch 104, a helical biasing spring 106 (see FIG. 6), an indicator peg 108 and a seal 110. The mode change knob assembly is mounted within an aperture formed in a wall of transmission housing 52, the edge of the aperture locating within slots 112 formed between a wall 114 and protrusions 116 on the knob 102. The mode change knob assembly 100 can rotate about an axis 120 within the aperture. The knob 102 comprises a peg 118 which engages with the mode change mechanism of the hammer drill. Rotation of the mode change knob assembly 100, results in rotation of the peg 118 about axis 120 which results in the peg 118 adjusting the mode change mechanism to change the mode of operation of the hammer drill. The seal 110 surrounds the knob 102 and engages with the transmission housing 52 to provide a grease seal, thus preventing grease from within the transmission housing 52 exiting through the aperture for the mode change knob assembly 100 in the wall of the transmission housing 52.

Figure 7:
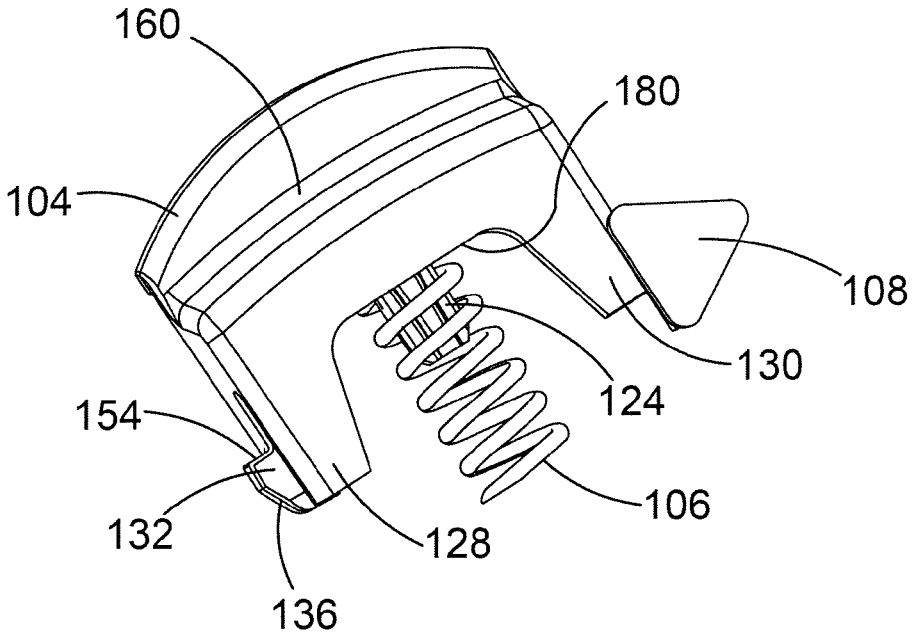
FIG. 7 shows a top view of the latch, biasing spring and indicator peg only.
Figure 8:
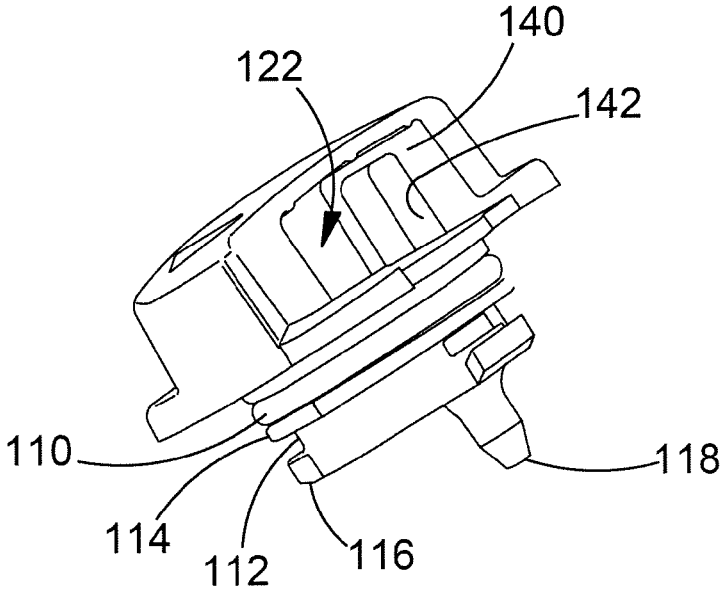
FIG. 8 shows a first perspective view of the slot of the knob with the latch, peg and biasing spring omitted.
Figure 9:
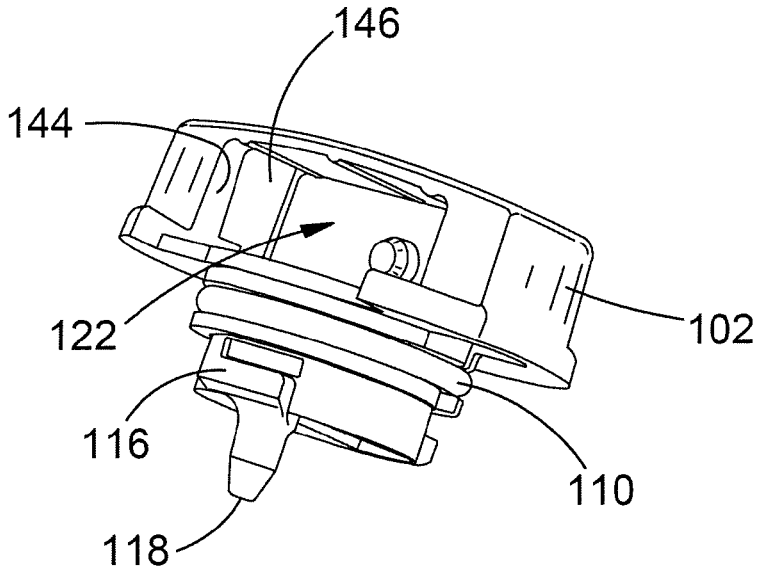
FIG. 9 shows a second perspective view of the slot of the knob with the latch, peg and biasing spring omitted.

A slot 122 (as best seen in FIGS. 8 and 9) is formed within the knob 102. Slideably mounted within the slot 122 is the latch 104. Formed on an inner wall of the latch 104 is a projection 124 (as seen in FIG. 7). One end of the helical biasing spring 106 is mounted on the projection 124. The projection 124 and spring 126 are located within the slot 122 of the knob 102, the spring 106 being sandwiched between inner wall of the latch 104 and a rear inner wall of the slot 122 under compression force. The spring 106 biases the latch 104 out of the slot 122.

Figure 5:
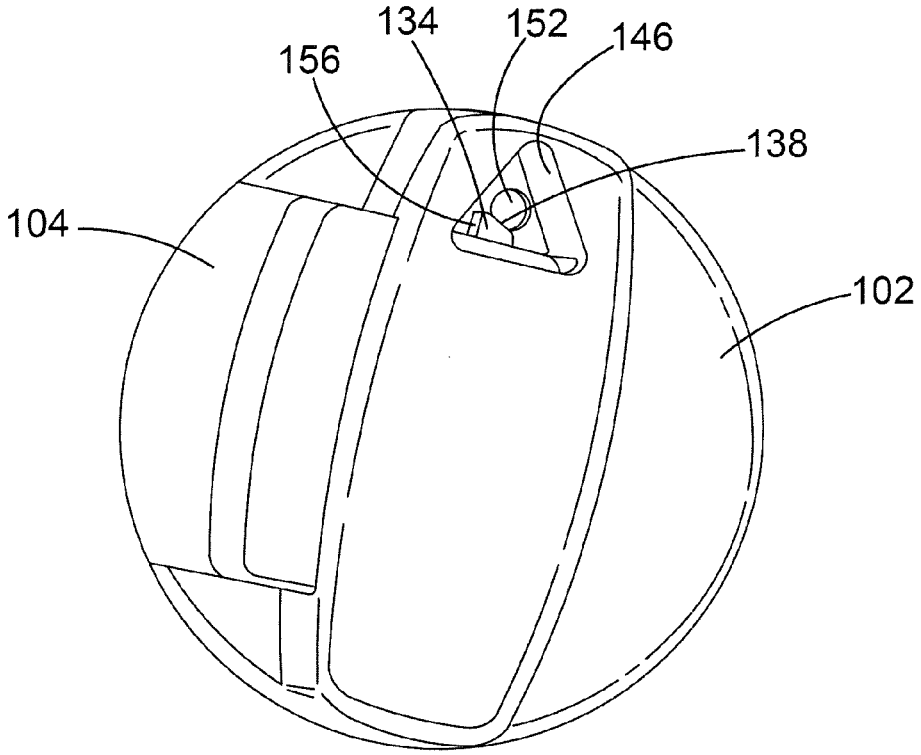
FIG. 5 shows a top view of the knob and latch only.
Figure 10:
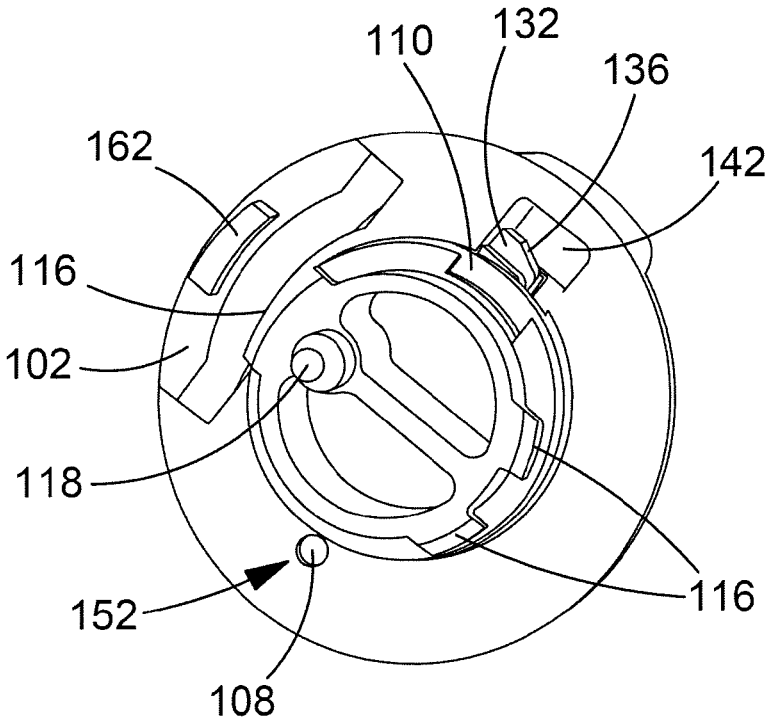
FIG. 10 shows an underside view of the mode change knob assembly.

Formed on each side of the latch 104 are two rearwardly extending arms 128, 130. The arms 128, 130 are resiliently deformable and can be bent towards each other. Integrally formed on the rear end of the arms 128, 130 are two catches 132, 134, which project sideways, perpendicularly to the arms 128, 130. A chamfer 136, 138 is formed on the rear of each of the catches 132, 134. Formed in one of the side walls 140 of the slot 122 is a rectangular recess 142 (as seen in FIG. 8), the entrance to the rectangular recess 142 from the slot 122 forming an intersection. The rectangular recess 142 extends to the base of the knob 102 as best seen in FIG. 10. Formed in the other of the side walls 144 of the slot 122 is a triangular recess 146 (as seen in FIG. 9), the entrance to the triangular recess 146 from the slot 122 forming an intersection. The triangular recess 146 extends to the top of the knob 102 as best seen in FIG. 5. A small hole 152 is formed in the base of the triangular recess 146 which extends to the base of the knob 102. The triangular indicator peg 108 locates within the triangular recess 146. The triangular indicator peg 108 has a recess 150 formed in one side. When the mode change knob assembly 100 is assembled, one of the catches, 132 extends into the rectangular recess 142 and is cable of sliding in a forward and rearward manner within the rectangular recess 142. The other of the catches 134 extends into the recess 150 of the triangular indicator peg 108, and is cable of sliding in a forward and rearward manner within the recess 150 of the indicator peg 108. When the latch 104 is biased to its most forward position, one side 154 of one of the catches 132 engages with side of the rectangular recess 142, one side 156 of the other catch 134 engaging with the side of the recess 150 in the indicator peg 108, thus defining the latch's 104 outer most position and preventing the latch from being pushed completely out of the slot 122. When the catch 134 is located within the recess 150 of the peg 108, the peg 108 is held within the triangular recess 146 of the knob 102, the catch 134 prevent the peg 108 from being removed from the triangular recess 146. Similarly, the peg 108 restricts the movement of the catch 134 and thus retains the catch 134 within the slot 122.

Formed on the outer portion of the latch 104 is a finger grip 160. Extending from the base of the finger grip 160 is a tooth 162. Formed around edge of the aperture in the wall of the transmission housing 52 for receiving the mode change assembly 100 are a series of indentations. When the mode change knob assembly is rotated within the aperture so that the tooth 162 is aligned with one of the indentations, the tooth 162 is cable of entering the indentation due to the biasing force of the spring 106. Each of the indentations is located at an angular position where the mode change knob assembly needs to be orientated in order to activate one of the modes of operation of the hammer drill.

During the normal use of the hammer drill, the tooth 162 is located in one of the indentations and the hammer is operated in particular mode of operation. When the operator wishes to alter the mode of operation of the hammer drill, the operator must do so by rotating the mode change knob assembly 100. In order to do, the operator presses the finger grip 160 of the latch 104 to push the latch 104 into the slot 122 of the knob 102 against the biasing force of the spring 106. As the latch 104 moves the catches 132, 134 slide rearwardly within the recesses 142, 150 and the tooth 162 disengages from the indentation. Once clear of the indentation, the operator can rotate the mode change knob assembly 100 until the tooth becomes aligned with another indention when the tooth 162 will enter this indentation under the biasing force of the spring 106 to lock the mode change knob assembly against further rotation and in an angular position which it needs to be in for the mode change mechanism to operate in a new mode of operation. The operator can then commence to use the hammer drill in the new mode of operation.

Molded onto the outer surface of the transmission housing 52, around the mode change knob assembly 100, are a number of symbols 164 (see FIG. 1) which represent the modes of operation of the hammer drill. The indicator peg 108 acts as an arrow and provides a visual indicator to the operator as to where the operator should rotate the knob 102 and to what mode of operation the hammer drill will operate in when it is in that angular position. When the indicator peg 108 points to a symbol, it indicates that the tooth 162 is aligned with an indentation and therefore can be locked in that position. The particular symbol the indicator peg 108 is pointing to will inform the operator what mode of operation the hammer drill will operate in when the mode change knob assembly is in that angular position.

The method by which the mode change knob assembly 100 is assembled and disassembled will now be described.

Firstly, the seal 110 is placed on the knob 102. The spring 106 is placed onto the projection 124 of the latch 104. The triangular indicator peg 108 is inserted into the triangular recess 146 with the recess 150 facing towards the slot 122 of the knob 102. The latch 104 and spring is then slid into the slot 122 with the rearwardly extending arms 128, 130 entering the slot 122 first. As the arms 128, 130 enter the slot 122, the two chamfers 136, 138 engage with the side walls 140, 144 of the slot 122 and push the arms 128, 130 inwardly towards each other against the biasing force of the arms 128 allowing them and the latch 104 to enter the slot 122. The latch is pushes into the slot 122 until the catches 132, 134 align with and then engage with the rectangular recess 142 on one side and the recess 150 of the peg 108 on the other due to the biasing force of the arms 128, 138. The arms 128, 130 then hold the catches 132, 134 in the rectangular recess 142 and recess 150 of the peg 108. As the latch 104 is slid into the slot 122, the spring 106 becomes compressed. Whilst the catches 132, 134 are in the rectangular recess and recess 150 of the peg 108, the latch 104 is locked inside of the sot 122 and is prevent from escaping. The mode change knob assembly is then inserted into the aperture of the transmission housing with the 118 engaging the mode change mechanism 40. The edges of the wall of the transmission housing are located within the slots 112 to hold and guide the knob 102. The mode change knob assembly 100 is secured to the transmission housing 52.

The advantage of this design of mode change knob mechanism is that peg 108 is used to secure the latch 104 within the slot 122. Furthermore, the latch 104 is used to secure the peg 108 within the triangular recess 146. Furthermore, the peg 108 is used to act as a visual indicator for the operator to inform the operator of the alignment positions of the mode change knob assembly 100 and the mode the hammer drill will operate in when in that angular position.

To disassemble the mode change knob assembly, the mode change knob assembly 100 is removed from the transmission housing 52. A tool is then inserted in the entrance of the rectangular recess 142 on the base of the knob 100 (shown in FIG. 10) and engages with the catch 132 located within the rectangular recess 142. The catch 132 is then pushed out of the rectangular recess 142 using the tool and into the slot 122, bending the arm 128 as it does so. The latch 104 is then twisted within the slot 122 about an axis parallel to the rotational axis of the knob 102 to draw out the latch 104, both arms 128, 130 bending as it brought out. The size of slot 122 and the flexibility of the arms 128, 130, is sufficient to allow the latch 104 to be removed. The peg 108 can then be pushed out of the triangular recess 146 by inserting a pin through the small hole 152 in the base of the triangular recess 146 to engage with the peg 108 and then subsequently push the peg 108 out. The seal 110 and spring can then be removed.

The invention claimed is:

1. A knob assembly for a power tool comprising:

a knob having a slot and a knob recess, the slot and knob recess intersecting each other at an intersection within the knob;

a latch slideably mounted within the slot; and a peg located within the knob recess and comprising a peg recess that faces towards the slot through the intersection;

wherein the peg and latch engage with each other via the intersection in order for the peg to retain the latch within the slot and for the latch to retain the peg within the knob recess, and wherein the latch comprises a catch that locates in and is slidable within the peg recess, the sliding movement of the latch within the slot being restricted by the sliding movement of the catch within the peg recess.

2. The knob assembly according to claim 1 wherein the latch comprises a resilient arm, the catch being mounted on the resilient arm, the resilient arm urging the catch into the peg recess.

3. The knob assembly according to claim 2 wherein the latch has the same width as the slot;

wherein the resilient arm extends in a lengthwise direction on the latch;

wherein the catch extends sideways from the resilient arm beyond the width of the latch through the intersection and into the peg recess.

4. The knob assembly according to claim 3 wherein the slot comprises a second recess formed within a side wall of the slot;

wherein the latch comprises two resilient arms which extend in the same lengthwise direction, each arm having a catch mounted on it, each of which extend sideways beyond the width of the latch in a direction opposite to the other catch;

wherein one catch extends from the resilient arm upon which it is mounted through the intersection and into the peg recess, the other catch extending from the resilient arm upon which it is mounted into the second recess.

5. The knob assembly according to claim 1 wherein there is a biasing mechanism which biases the latch to a first position within the slot, the catch engaging with a side wall of the peg recess to define that position.

6. The knob assembly according to claim 1 wherein part of the peg within the knob recess is visible from the exterior of the knob, the visible part providing a visual indicator to the operator.

7. The knob assembly according to claim 6 wherein the shape of the visible part of the peg is triangular which acts as an arrow indicator.

8. The knob assembly according to claim 7 wherein the arrow indicator is capable of pointing to indicators on a power tool indicative of the angular position of the knob assembly on a power tool.

9. A hammer drill comprising:

a housing;

a motor mounted within the housing;

a tool holder mounted on the housing;

a transmission mechanism mounted with the housing which utilizes the rotary output of the motor to drive a cutting tool, when held within the tool holder, in at least two modes of operation;

a mode change mechanism which switches the transmission mechanism between the at least two modes of operation; and a knob assembly which engages with and is configured to adjust the mode change mechanism so that it switches the transmission mechanism between the at least two modes of operation;

wherein the knob assembly comprises:

a knob having a slot and a knob recess, the slot and knob recess intersecting each other at an intersection within the knob;

a latch slideably mounted within the slot;

a peg located within the knob recess and comprising a peg recess that faces towards the slot through the intersection; and wherein the peg and latch engage with each other via the intersection in order for the peg to retain the latch within the slot and for the latch to retain peg within the knob recess, and wherein the latch comprises a catch that locates in and is slidable within the peg recess, the sliding movement of the latch within the slot being restricted by the sliding movement of the catch within the peg recess.

* * * * *